US006758539B2

(12) United States Patent
Cianetti

(10) Patent No.: US 6,758,539 B2
(45) Date of Patent: Jul. 6, 2004

(54) CIRCULAR TRANSLATION OPENING SYSTEM FOR PLATES OF COUNTERS AND DISPLAY UNITS

(75) Inventor: Alessandro Cianetti, Gorizia (IT)

(73) Assignee: N.E.M. Nord EST Meccanica S.n.c., S. Pier d'Isonzo (IT)

( * ) Notice: Subject to any disclaimer, the term of this patent is extended or adjusted under 35 U.S.C. 154(b) by 12 days.

(21) Appl. No.: 10/153,893

(22) Filed: May 24, 2002

(65) Prior Publication Data

US 2003/0051609 A1 Mar. 20, 2003

(30) Foreign Application Priority Data

Sep. 17, 2001 (IT) ..... TS2001A0022

(51) Int. Cl.[7] ..... A47B 97/00
(52) U.S. Cl. ..... 312/139.2; 312/137
(58) Field of Search ..... 312/114, 116, 312/137, 138.1, 139, 139.1, 139.2, 140.4

(56) References Cited

U.S. PATENT DOCUMENTS 4,208,972 A * 6/1980 Arend et al. ..... 108/184
4,807,312 A * 2/1989 Baus ..... 4/607

FOREIGN PATENT DOCUMENTS

| | | | | |
|---|---|---|---|---|
| FR | 544394 | * | 9/1922 | ..... 312/139.2 |
| IT | 498575 | * | 9/1954 | ..... 312/139.2 |

* cited by examiner

*Primary Examiner*—James O. Hansen
(74) *Attorney, Agent, or Firm*—Browdy and Neimark, P.L.L.C.

(57) ABSTRACT

The opening system entails a longitudinal translation and a rotation of plates of a counter or display unit along the customer's side; each plate is fixed to a first bar; the latter is hinged to two supporting arms by pivots and at its turn each supporting arm is hinged to a lower bearing bar by two further pivots; the supporting arms are parallel and the pivots insist on their ends; a gas-actioned piston is connected to a supporting arm; the lower bearing bar is shaped in such a way to house in its section all the moving mechanics of plates; the two supporting arms of each plate in co-operation with each bar on which the plate-holding clamps are attached and the lower bearing arm form a parallelogram-like moving system.

8 Claims, 5 Drawing Sheets

CIRCULAR TRANSLATION OPENING SYSTEM FOR PLATES OF COUNTERS AND DISPLAY UNITS

FIELD OF APPLICATION

The system as per subject can be validly employed in the sector of display units and the refrigerated, neutral, warm counters destined to both the retail sale of foodstuff and jewellery, toys, etc., etc.

STATE OF THE ART

The counters and display units for selling foodstuff or non-food products are always equipped with glass or plastic plates. The function of the latter is that of isolating the food contained into them from the external environment and/or that of avoiding that customers may touch the displayed goods. The plates are hinged in different ways to a lower frame or to an upper frame sustained by posts.

The opening systems based on the upper frame, though valid, are affected by some problems. First of all, to support the plates, it is necessary to have profiled bars with relevant section so as to avoid twisting and deformation of the frame itself. This entails two consequences: a higher cost of production of the counters and display units and a lower quality of the display and of the visibility of the goods on sale. Furthermore, the employed gas-actioned pistons are often subject to wear in time, with a subsequent danger of collapse for the plates from their maximum opening position. Apart from these anomalies, there is however the constant possibility for operators to get head injuries when the plates are lifted up.

In the systems with downward openings each plate is hinged to the lower frame. Its movement is made easier since at least one side always remains attached to the display or the glass and thus the physical strain is decreased. But even this solution cannot solve all the problems for operators either. With the downward opening of large crystals it is actually needed to support them manually while cleaning and placing/replacing operations of goods are carried out so to avoid the breakage of hinges. The strain for operators is thus doubled: on one hand the efforts of holding the plates, on the other that of being incapable of moving along the display as the latter is mostly occupied by the lifted plates.

SUMMARY OF THE INVENTION

The present invention provides a system with a sliding movement of plates that resolve the previously mentioned problems.

This and other purposes are achieved by this claimed system based on a circular translation movement of plates for counters and display units, which entails a longitudinal sliding of glass or plastic plates, independently from their number, along the customer's side. Simultaneously with the sliding, there is a rotation of each plate as clarified later on.

Each plate is attached to a first bar. Such first bar is then hinged to two supporting arms through pivots and each supporting arm is hinged to a lower bearing bar, attached to the display or glass by means of two further pivots. The two supporting arms are parallel and the pivots insist on close to their ends.

An elastic device is connected to one of the two supporting arms of each plate. The device is hinged to the supporting arm itself and to the bearing lower bar of the counter or display by two pivots.

Each plate can be slid to the right or the left (for an observer standing in front of the display on the customer's side) according to the orientation of the supporting arms. Consequently the way in which the various plates open themselves depends only on the user's requirements and/or the space available in the location that is going to lodge the display or the glass.

The bearing lower bar has a shaped section so as to be able to lodge internally the supporting bars, the bars which the plate-holding clamps and the elastic devices are attached to. Also the supporting arms house the elastic devices so as to allow for a complete folding of all the moving elements in a narrow space when they are in a rest position. To allow for the above mentioned total folding, some housings suitable for lodging some of the above mentioned pivots are created in the bars which the plate-holding clamps are attached to. To avoid that, for accidental reasons, the plates move away from the display or the glass when they are at rest, the bearing lower bar is equipped with a magnetic washer acting on the bars fixed to the clamps of the plates.

The two supporting arms in co-operation with each bar capable of holding a plate and the lower bearing bar make up a parallelogram-like moving system. The plate, throughout and at the end of its opening movement, has the same vertical slant that it takes when at rest. Each plate, at the end of the run, places itself on one side of its resting position, always close to the counter or display unit though detached from it for as much as it is necessary to overlap the nearby plate for at least two thirds. With this movement the plate leaves a free space in the counter or display unit having a length that corresponds to that of the two superimposed plates and therefore equal to two thirds of the length of the plate itself.

The opening system of the plates in question is alternative to the upwardly lifting systems of plates as well as to the traditional ones that have a simple downward rotation of the plates themselves.

Each plate, which perfectly matches with the one at its side when at rest, can be opened independently. When the plates have to be operated at least one of them is moved away from the counter or display unit and is turned to the right or to the left. The weight of the plate discharges itself on the lower bearing plate, as in the traditional downward opening systems but the presence of the foreseen supporting arms avoids the necessity of holding it. This allows not only to reduce the strain for operators but also to give them a higher safety degree, as no longer there are lifted weights that might suddenly drop or the possibility of bumping the head against the edges of the upwardly lifted plates. Actually the installed elastic devices are used only to ease the opening of plates and not as a safety brake for a sudden collapse or closure of themselves. Moreover, the advantages for operators are remarkable since the plates do not obstacle during such operations. The cleaning of counters and display units is easy, since by opening the plates one after another, every corner can be reached.

The claimed moving system enables to manufacture counters or display units with the upper part free from any bar or bearing element, thereby giving a greater visibility to the product on sale. But obviously nothing prevents from placing some upper posts at the back to support the intermediate shelves on the counters or display units or as a support for an additional lighting different from the natural one.

The special orientation of the supporting bars for moving the plates into the lower bearing bar obstacle their view by the customers. At the same time it allows for an easy fitting, with a remarkable reduction of costs. Another diminution of costs can be obtained by using lighter bearing frames since, being all the mechanics housed into the lower part of the display or glass, the torsion forces are extremely reduced with respect to the systems using upward opening systems.

SHORT DESCRIPTION OF THE DRAWINGS

Further features and advantages of the invention will appear more clearly from the description of an embodiment, preferred but not necessarily sole, of the claimed system, which is illustrated for indicative and not restricted purposes in the enclosed drawings, where:

DETAILED DESCRIPTION OF A PREFERRED EXAMPLE OF EXECUTION

Figure 1:
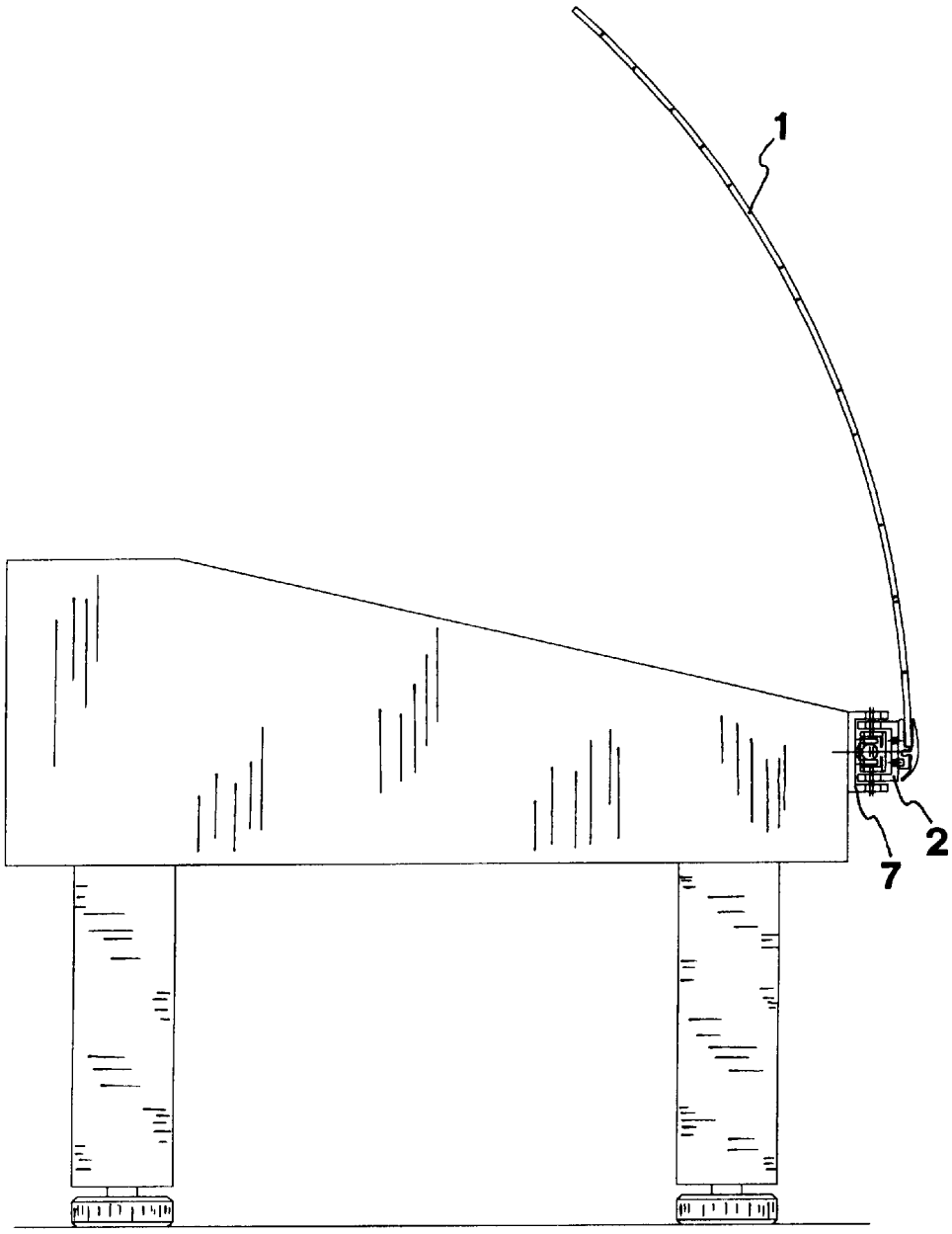
FIG. 1 shows a side view of a display that uses the system of this claim.
Figure 2:
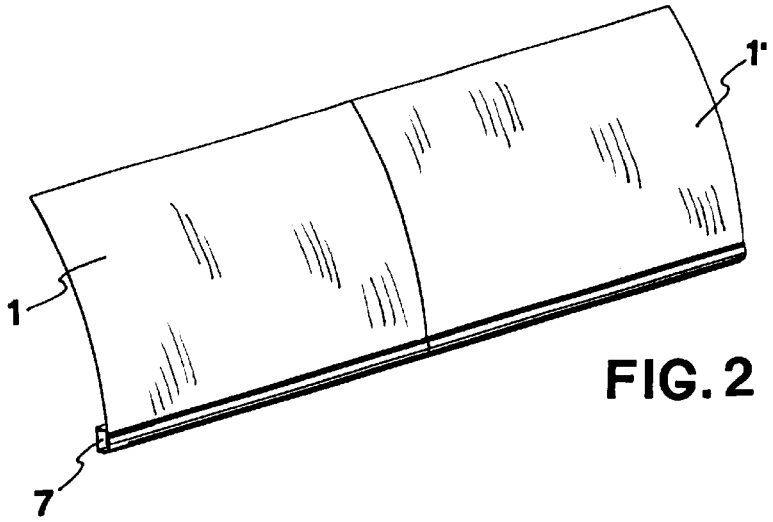
FIGS. 2, 3 and 4 illustrate a perspective of two plates throughout the stages when both plates respectively are at rest, one plate is lifted up and the other is at rest and vice versa.
Figure 3:
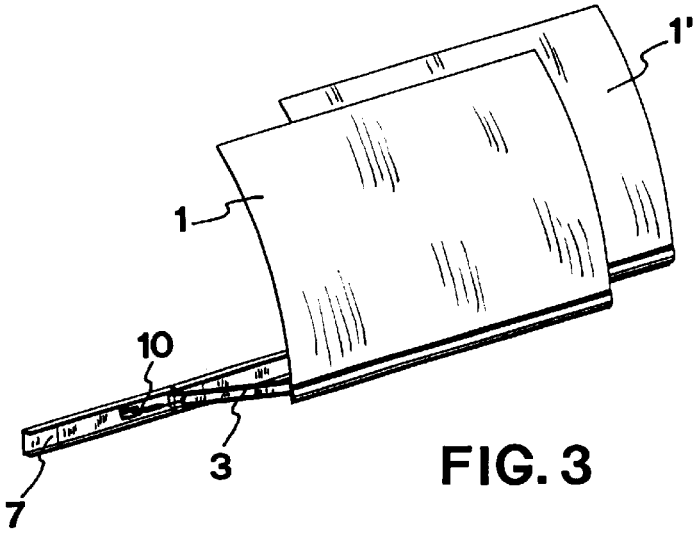
Figure 4:
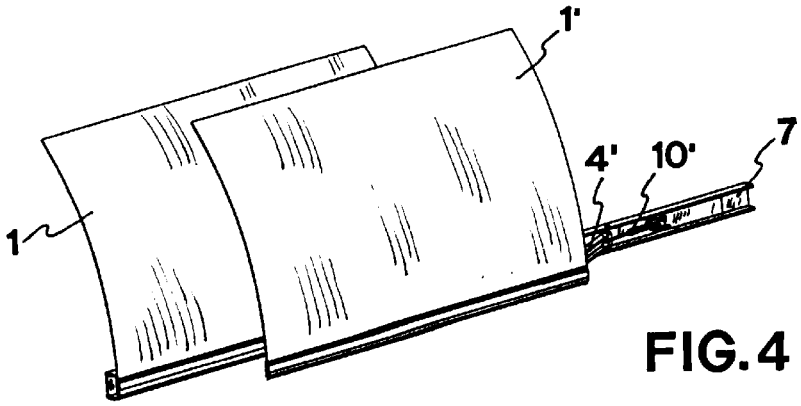
Figure 5:
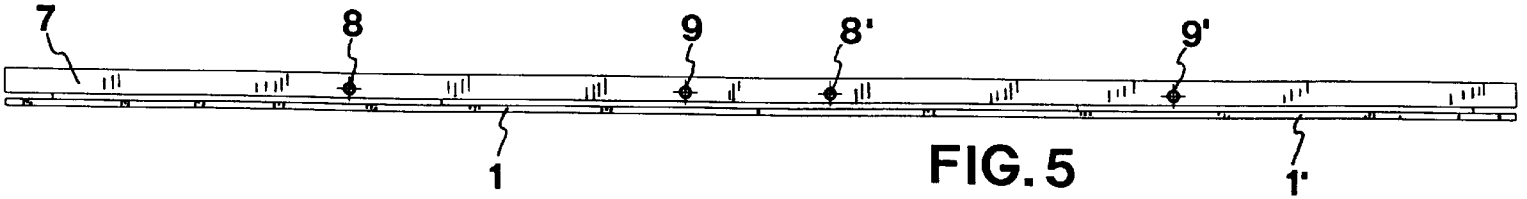
FIGS. 5, 6 and 7 show the same amount of top views of two plates and their moving mechanics at the same stage as by FIGS. 2, 3 and 4.
Figure 6:
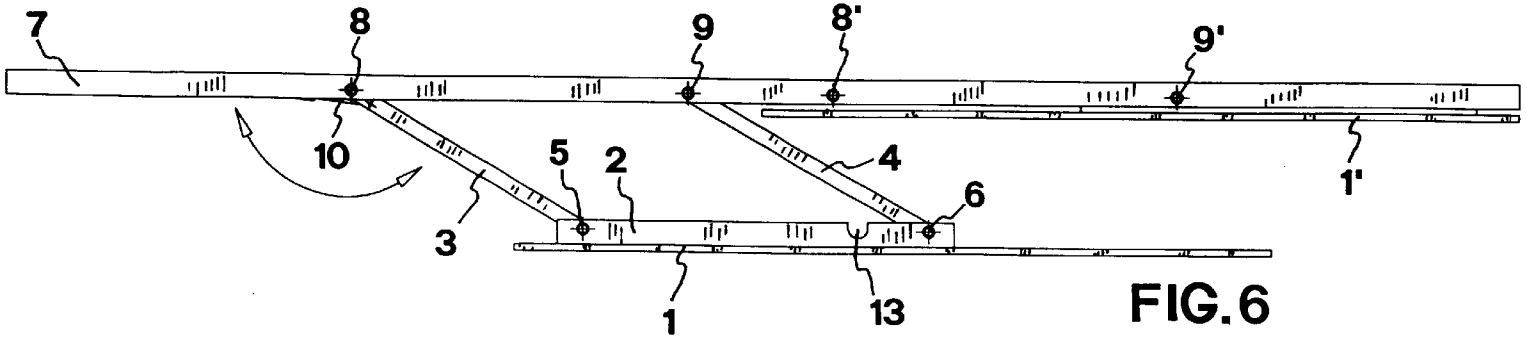
Figure 7:
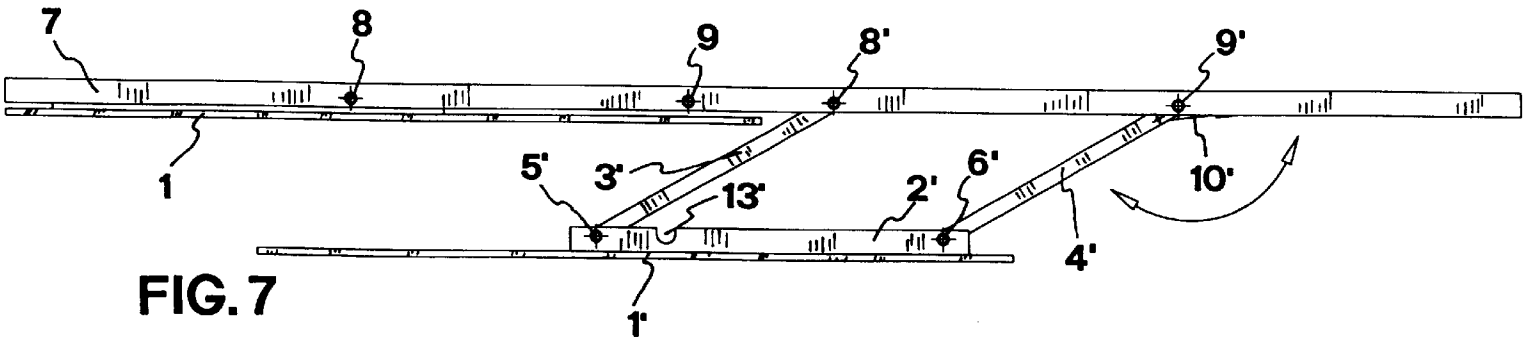
Figure 8:
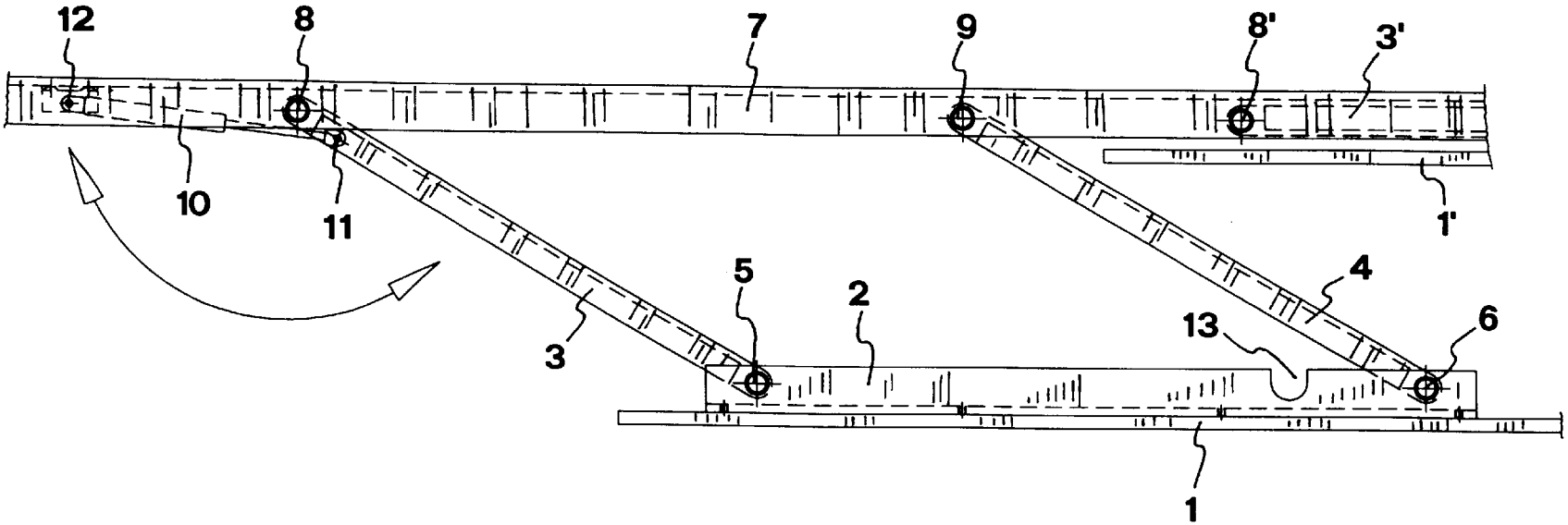
FIG. 8 shows, more in detail, a top view of a plate and its related mechanics in a moving stage.
Figure 9:
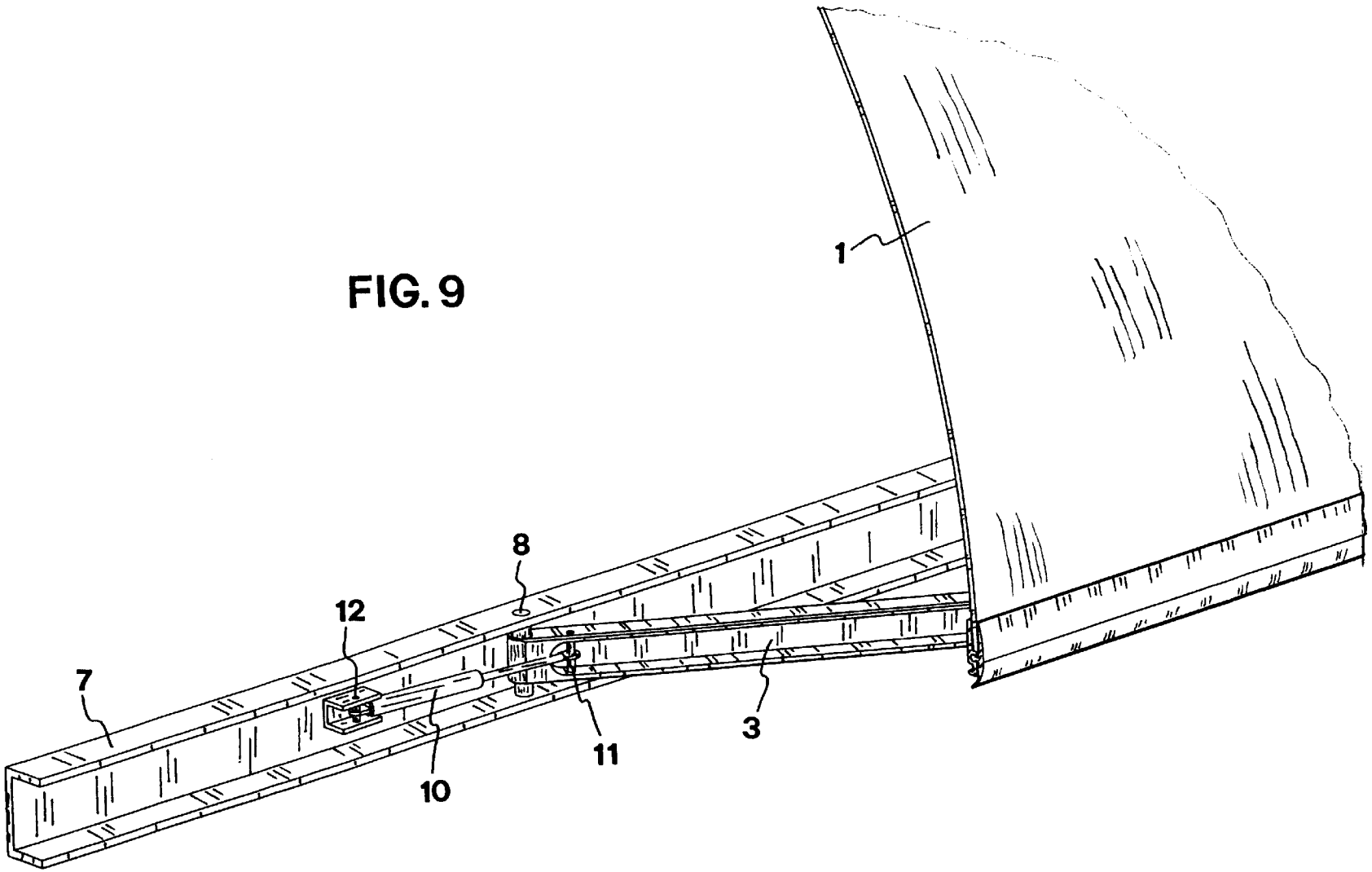
FIG. 9 shows, even more in detail, a perspective of a lifted plate and part of the related mechanics.

More specifically, the claimed opening system involves in this example the use of two glass plates 1, 1' placed on the customer's side on the display. The latter is without an upper bar. Each plate 1, 1' is fixed through clamps to a first bar 2, 2', having a minor length with respect to that of plates 1, 1'. Each first bar 2, 2' is at its turn hinged to two supporting arms 3, 4, 3', 4' through the pivots 5, 6, 5', 6'. At its turn each arm 3, 4, 3', 4' is hinged to a lower bearing bar 7 through two further pivots 8, 9, 8', 9'. The bearing bar 7 is fixed to the display. The two supporting arms 3, 4, 3', 4' are parallel and the pivots 5, 6, 5', 6', 8, 9, 8', 9' insist on at their ends.

A gas-actioned piston 10, 10' hinged by means of a first pivot 11, 11' is connected to a point of the supporting arm 3, 4' itself proximal to the lower bearing bar 7 and by means of a secondary pivot 12, 12' to this last bearing bar 7.

The bearing bar 7 is a 90° U-shaped and houses all the above mentioned components, apart from the plates 1,1' and the clamps holding them. The supporting arm 3, 4' is also made up of a 90° U-shaped bar and allows for a complete housing of the piston 10, 10' inside it when it is at rest. To allow for total folding of the first bars 2, 2', of the supporting arms 3, 3', 4, 4' and of the pistons 10, 10' into the lower bearing bar 7 some housing 13, 13' are created in the bars 2, 2' themselves and they are capable of lodging the pivots 8, 9'.

The two supporting arms 3, 4, 3', 4' in co-operation with each first bar 2, 2' ad the lower bearing bar 7 form a parallelogram-like moving system.

When the plates 1, 1' are closed they are sided and match perfectly. If one plate 1, 1' is to be moved from its position it is necessary to grip the clamp holding the plate 1, 1' itself and pull it towards the customer's side with a light movement sufficient however to detach the plate 1, 1' from its rest position. Once this operation has been carried out it is sufficient to push slightly the plate 1, 1' to the right or to the left (for an observer standing in front of the counter on the customer's side) according to the fact whether it is the plate 1 located to the left of the counter or the plate 1' located on the right of the counter itself.

The opening of the plate 1, 1' occurs automatically thanks to the push of the piston 10, 10'. The force exerted by the latter is limited since it operates with a nearly total absence of opposing forces. By taking into account the parallelogram-like moving system, the movement occurs with a simultaneous rotation and a translation as far as the stop point. In detail, the plate 1 group (located on the left of the counter)—bar 2—supporting arms 3, 4 moves away from the counter customer's side and at the same time it rotates to the right according to a plane which is parallel to the ground and having as a fulcrum the two pivots 8, 9 hinged to the lower bearing bar 7. Simultaneously, there is a rotation and a translation of the supporting arms 3, 4 with respect to the plate 1 group—bar 2 having as fulcrum the pivots 5, 6 that join the arms 3, 4 with the bar 2 itself.

The plate 1, during and at the end of the movement, has the same vertical slant that it had in the rest position. In other words at the end of the run itself it engages itself in a rest position, always close to the counter, by overlapping partially to the remaining plate 1'. With this movement the plate 1 leaves however a space in the counter which is as long as two thirds of the length of the plate 1 itself. It is thus possible for the operator to gain access to the corresponding inner location of the counter to perform the usual daily operations of loading, unloading and cleaning.

The same kind of movement occurs for the group constituted by the plate 1' (located to the right of the counter)—bar 2'—supporting arms 3', 4'. The only difference consists of the fact that the translation of the plate 1' occurs to the left so as to allow the performance of the daily operations also in this free zone of the counter.

For closing the same operations are carried out in the opposite way till when the plate 1, 1' is again close to the lower bar 7. By exerting a light pressure on the plate 1, 1' orthogonal to the counter the plate 1, 1' is eventually taken to the point of closure.

The piston 10, 10' is used only to ease the opening and it is no longer used as a safety brake for a collapse or closure of the glass, therefore even if it were discharged the operator would be at no risk. Actually the weight of plate 1, 1' insists completely on the supporting arms 3, 4, 3', 4'.

What is claimed is:

1. A circular translation opening system for plates of counters and display units, whereby the plates slide longitudinally and at the same time they rotate, characterised by the fact that each plate is fixed to a first bar having a length which is shorter than that of each plate; whereby each plate is fixed to said respective first bar directly or by clamps;

two supporting arms are hinged to each of said first bars by pivots;

the two supporting arms of each first bar are hinged by other pivots to a lower bearing bar fixed to the counter or the display unit;

said supporting arms are parallel and their pivots are positioned near ends of the supporting arms;

an elastic device is connected to at least one supporting arm;

a first end of said elastic device is hinged by a first pivot to a point close to the lower bearing bar of the at least one supporting arm;

a second end of said elastic device is hinged by a second pivot to the lower supporting bar;

the two supporting arms of each plate in co-operation with each first bar and the lower bearing bar form a parallelogram moving system; and each plate may translate to the right or to the left according to the orientation of the supporting arms.

2. An opening system, according to claim 1 wherein said lower bearing bar is shaped to house said first bars, the supporting arms and the elastic device.

3. An opening system, according to claim 2, wherein said lower bearing bar has a "U" shape turned 90° .

4. An opening system, according to claim 1, wherein said supporting arms are shaped to house the elastic device.

5. An opening system, according to claim 4, wherein said supporting arms have a "U" shape turned 90° .

6. An opening system, according to claim 1, wherein at least one housing is formed in the first bars; said at least one housing being suitable for lodging at least one of the pivots that hinge the supporting arms to the lower bearing bar.

7. An opening system, according to claim 1, wherein the lower bearing bar is provided with a magnetic washer, acting on said first bars.

8. An opening system, according to claim 1, wherein the length of said lower bearing is the same as the combined lengths of the plates.

* * * * *